US009368092B2

(12) United States Patent
Hooker

(10) Patent No.: US 9,368,092 B2
(45) Date of Patent: Jun. 14, 2016

(54) NECK ADJUSTMENT MECHANISM FOR STRING INSTRUMENT

(71) Applicant: Stuart A. Hooker, Pittsfield, NH (US)

(72) Inventor: Stuart A. Hooker, Pittsfield, NH (US)

( * ) Notice: Subject to any disclaimer, the term of this patent is extended or adjusted under 35 U.S.C. 154(b) by 0 days.

(21) Appl. No.: 14/339,909

(22) Filed: Jul. 24, 2014

(65) Prior Publication Data

US 2016/0027415 A1 Jan. 28, 2016

(51) Int. Cl.
*G10D 3/00* (2006.01)
*G10D 3/06* (2006.01)

(52) U.S. Cl.
CPC ..... *G10D 3/06* (2013.01)

(58) Field of Classification Search
CPC ..... G10D 3/06
USPC ..... 84/293
See application file for complete search history.

(56) References Cited

U.S. PATENT DOCUMENTS 4,064,780 A * 12/1977 Bond ..... G10D 3/12 84/298
6,350,940 B1 * 2/2002 Upchurch ..... G10D 3/06 84/290
7,157,634 B1 1/2007 Babicz
7,557,281 B1 7/2009 Campling
7,875,782 B1 * 1/2011 Nechville ..... G10D 3/06 84/173

* cited by examiner

*Primary Examiner* — Jianchun Qin
(74) *Attorney, Agent, or Firm* — Davis & Bujold PLLC; Michael Bujold

(57) ABSTRACT

An adjustment mechanism for a stringed instrument in which the stringed instrument comprises a guitar body, a bridge supported by the guitar body, a saddle affixed to the bridge, a neck pivotably coupled to the guitar body, a fretboard supported by the neck, a nut affixed to the neck adjacent a headstock, and a plurality of strings extending between the nut and the saddle. The nut substantially forms a pivot axis for at least the fretboard, and a heel end of at least the fretboard is pivotably about the pivot axis, via an adjustment mechanism, for adjusting an action of the strings. A method of adjusting string action of a stringed instrument is also disclosed.

20 Claims, 13 Drawing Sheets

FIG. 5
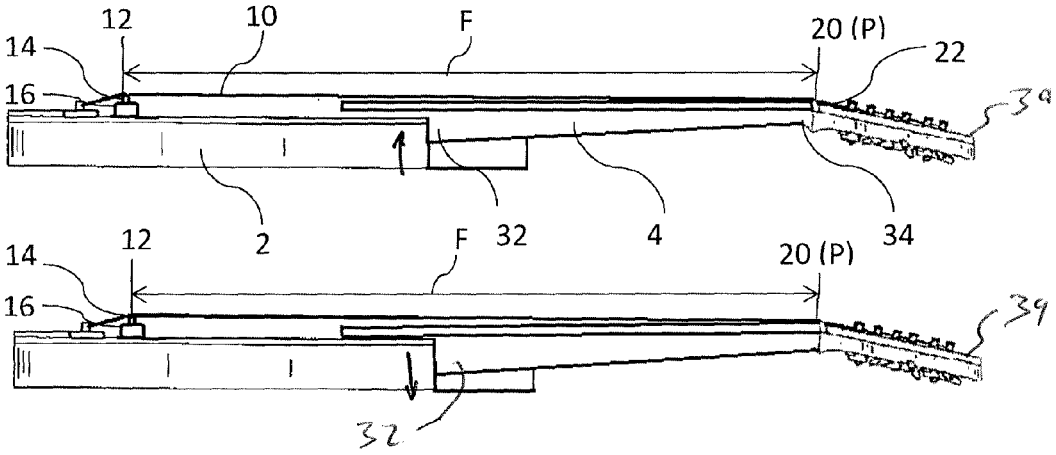
FIG. 6
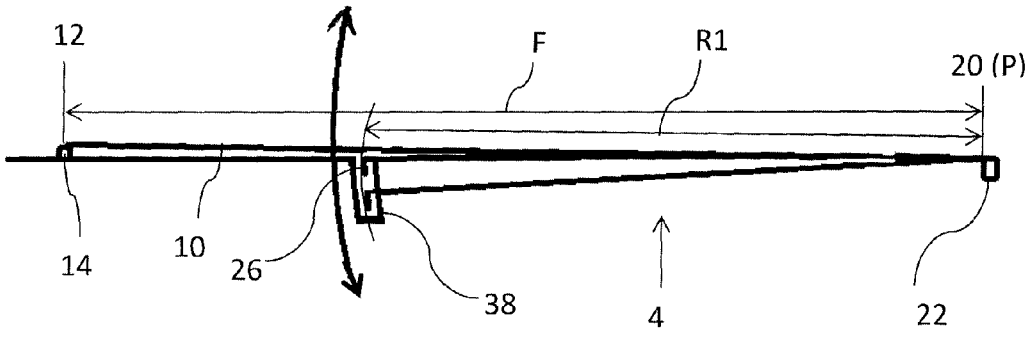
FIG. 7

NECK ADJUSTMENT MECHANISM FOR STRING INSTRUMENT

BACKGROUND OF THE INVENTION

1. Field of the Invention

The present invention relates to a neck adjustment mechanism for a string instrument, and more particularly to a guitar neck adjustment mechanism which maintains the pitch and the intonation qualities during adjustment of the neck.

2. Description of the Related Art

As is well known in the art, the primary quality attributes of guitars are tone (i.e., the audible nature of the instrument including volume, brightness, evenness, note separation, etc.), playability (i.e., the responsiveness of the instrument to the player's technique) and durability (i.e., the ability of the instrument to deliver tone and playability over years and decades).

With respect to playability, a critical aspect of playability is string action. Since each string on a steel string guitar is stretched to nearly thirty pounds of tension, the force required to fret the string is not insignificant. If the action is too high, playing is difficult, unpleasant and, in extreme cases, can cause repetitive stress injury. If the action is too low, the strings will "buzz" on the frets or may actually rest upon on the frets, making the instrument generally unplayable. The acceptable range for action is quite small—perhaps 0.1 of an inch or so. In view of this, guitars must be built very precisely with respect to neck angle and must maintain that critical geometry throughout time under the stress of nearly 180 pounds of string tension. It is to be appreciated that a rigid guitar structure generally tends to be excessively heavy and may compromise tone.

A lighter guitar structure tends to sound better with the risk that the neck may eventually pull up over time, altering the action of the strings to the point where the neck must eventually be reset, typically entailing a costly repair of many hundreds of dollars. Accordingly, the tone, the playability and the durability are fundamentally in combat with one another.

Since guitars are made mostly of wood, it is to be appreciated that the wood tends to move over time, not only under string tension but also in response to day to day humidity changes. A guitar with comfortably low action in Houston, Tex. may shrink enough, if flown to Minneapolis, Minn. for example during the winter, to be generally unplayable. The builder of the guitar must anticipate that the guitar may spend some time in low humidity so the stringed instrument must built with sufficiently action high to remain playable under all foreseeable circumstances. Unfortunately, generally the action will be sub-optimized when the humidity is higher.

As a result of the above, guitars normally tend to have an action that is higher than desirable to allow for the possibility that the stringed instrument will eventually experience a low humidity environment. As string tension gradually deforms the wood structures over time, the action is likely to increase and progressively get worse. Modification of the action of the stringed instrument, by the musician/owner/technician/repair person, is typically hampered by the fact that many guitars have fixed necks which prevent any relatively easy adjustment of the string action.

One approach of attempting to modify the action of a guitar, with a fixed neck, is to unstring the guitar and then remove and shave the saddle. Since the height of the saddle is typically not very high, the saddle must be significantly shaved in order to have any real effect on the string action, and it is to be appreciated that this may only temporarily solve the problem. Moreover, a short saddle tends to reduce the leverage that the strings have to vibrate the top surface of the guitar body so both the tone and the volume of the guitar are generally compromised to some extend.

More often, the musician/owner/technician/repair person will attempt to adjust a truss rod. A truss rod generally consist of a threaded rod, with nuts located on either end thereof, which extends parallel to another rod or bar. By rotating the threaded rod in one direction or the other, the truss rod eventually begins to bend thereby causing the neck and associated fret board to also correspondingly bend. It is to be appreciated that using the truss rod to compensate for more than a few thousands of relief is generally a bad option because such adjustment frequently results in a broken truss rod and this typically leads to the guitar eventually being discarded by the owner.

Some builders have incorporated various mechanisms which adjust the neck/body geometry. Stauffer/Martin and Howe Orme are examples of renowned builders who, more than a century ago, employed adjustable neck systems. A number of builders today employ neck-to-body joins that can be adjusted in one manner or another. However, only a small fraction of all guitars have such neck adjustment systems.

The most common approach is to enable the headstock end of the neck to "tilt" slightly in relation to the body, e.g., pivoting where the neck heel contacts the body and the pivoting is controlled by a screw extending through the neck heel into the body well below the pivot point(s). Rotation of the screw in a first direction pulls the heel closer to the body and effectively pulls the neck back, reducing the distance from the strings to the fret board and lowering the string action—U.S. Pat. No. 7,157,634, for example. Because the pivot point is well below the plane of the strings, such tilting also increases the distance between the nut and the saddle. Since the strings are already under approximately 180 pounds of tension, considerable force must be applied by the adjustment mechanism so prudence may require the guitar to be unstrung before an adjustment is attempted. In any event, any stretching or relaxing the strings will change the pitch of the strings, thereby requiring the player to retune the guitar following adjustment thereof. It is to be appreciated that a significant adjustment may change the distance between the nut and the saddle enough that the new effective scale length no longer matches the layout of the frets and the instrument may sound out of tune.

Another approach is to raise and lower the entire neck with respect to the guitar body using, for instance, a sliding mortise and tenon joint. Such a system is described in U.S. Pat. No. 7,557,281, although other "elevator" systems are available and known in the art. Such elevator system typically also stretch or relax the strings, for a given change in action, but typically less than a tilt system discussed above. However, even if the direction of travel is very close to being precisely perpendicular to the string plane, some stretching or relaxing of the strings will typically occur as a matter of geometry, which changes the pitch of the strings.

Moreover, both approaches generally require a wrench, key or some other tool to operate the adjustment mechanism and may also require some combination of unstringing, adjustment, restringing and retuning. As such, these mechanisms require the musician/owner/technician person to first locate the required tool(s) and then perform the desired adjustment operation. To the extent that either mechanism is well-built and adjustments are properly made, either system may enable the player to maintain the action of the instrument within an acceptable range. However, such maintenance is fundamentally an off-line, technical process to be executed from time to time as the seasons change or the player travels from one climate to another.

SUMMARY OF THE INVENTION

Wherefore, it is an object of the present invention to overcome the above mentioned shortcomings and drawbacks associated with the adjustment mechanisms for the necks of string instruments according to the prior art.

A primary object of the invention is to facilitate quick and easy adjustment of the fret board position relative to the strings without the use of a wrench, a key or some other separate adjustment tool, so that the action of the strings can be readily and quickly be modified by the user or musician, either before, during or after playing the guitar, without effecting the pitch and the intonation of the strings.

Another object of the present invention is to provide an adjustment mechanism for the neck of a stringed instrument so that when the heel end of the fretboard/neck, located adjacent to the body, is adjusted with respect to the body, the fretboard/neck pivots about a pivot axis, defined by the nut of the neck, so that the action of the strings is adjusted without effecting the pitch and the intonation of the strings.

Still another object of the invention is to facilitate quick and easy adjustment of the relative height of the neck, with respect to the body of the stringed instrument, so that the action of the strings can be readily modified by the user or musician with normally requiring any retuning of the strings.

A further object of the invention is to provide a stringed musical instrument that contains an adjustable fretboard/neck assembly. The adjustable fretboard/neck assembly allows the user to quickly adjust a first end portion of the fretboard/neck assembly, located adjacent to the body of the stringed instrument, in a vertical direction without correspondingly altering the position of the nut of the fretboard/neck, located at the second opposite end thereof. Consequently, the user can quickly and efficiently change the action of the guitar without effecting the pitch and the intonation of the guitar strings by maintaining a constant position of the nut relative to the saddle.

Yet another object of the invention is to attach the neck to the stringed body generally by a 'heel-to-body' joint which provides a tight fitting interface between the neck and the stringed body to ensure that the neck can be securely mounted to the stringed body by a neck block with an internal pocket that is capable of receiving the heel of the neck and supporting the front, back and opposed sides of the heel to form a solid support structure which avoids any undesired turning, twisting or bending of the neck relative to the body.

A further object of the invention is to accommodate a heel of the neck within a pocket of the neck block so that the fit between the heel and the pocket of the heel block is sufficiently tight, so as to avoid undesired turning, twisting or bending of the neck, but yet loose enough to allow and permit the desired pivoting movement of the neck relative to the stringed body by manipulation of a neck height adjustment screw. To aid in the movement of the neck and minimize friction with the neck block, at least one of the heel and the neck block is either manufactured from or has a low friction surface which facilitates relative sliding movement between the heel and the associated neck block. If desired or necessary, the mating surfaces may be lubricated to assist further with facilitating the desired pivoting movement of the neck relative to the neck block. However, when the mating surfaces of the heel and the neck block comprise a self gliding material(s), such as polypropylene, a lubricant is typically unnecessary.

Still another object of the invention is to pass the neck height adjustment screw, through the rear surface of the body of the stringed instrument, so that the neck height adjustment screw directly engages with the heel of the neck to facilitate adjustment of the position of the heel relative to the rear surface of the stringed instrument. By such arrangement, the user or musician merely rotates the head of the adjustment screw, in either a clockwise or a counter-clockwise rotational direction, to raise or lower the heel portion of the neck with respect to the body of the stringed instrument, and thereby altering the action of the stringed instrument. Preferably, a knob, e.g., either plastic, wooden or metal, knob can be securely attached to the exposed head of the neck height adjustment screw. The knob may knurled or coated with an elastomeric material to facilitate gripping thereof. Accordingly, the user or musician can readily adjust the action of the strings by simply turning the knob in either a clockwise or counter-clockwise rotational direction.

The present invention also relates to an adjustment mechanism for a stringed instrument in which the stringed instrument comprises: a guitar body; a bridge supported by the guitar body; a saddle affixed to the bridge; a neck pivotably coupled to the guitar body; a fretboard supported by the neck; a nut affixed to the neck adjacent a headstock; and a plurality of strings extending between the nut and the saddle, wherein the nut substantially forms a pivot axis for at least the fretboard, and a heel end of at least the fretboard is pivotably about the pivot axis, via an adjustment mechanism, for adjusting an action of the strings.

The present invention also relates to method of adjusting string action of a stringed instrument in which the stringed instrument comprises a guitar body, a bridge supported by the guitar body, a saddle affixed to the bridge, a neck pivotably coupled to the guitar body, a fretboard supported by the neck, a nut affixed to the neck adjacent a headstock, and a plurality of strings extending between the nut and the saddle, the method comprising the steps of: pivotably supporting the neck with respect to the guitar body, via an adjustment mechanism, so that the nut substantially forms a pivot axis for at least the fretboard, and adjusting the string action of the stringed instrument by pivoting the heel end of at least the fretboard about the pivot axis via the adjustment mechanism.

BRIEF DESCRIPTION OF THE DRAWINGS

The accompanying drawings, which are incorporated in and constitute a part of the specification, illustrate various embodiments of the invention and together with the general description of the invention given above and the detailed description of the drawings given below, serve to explain the principles of the invention. It is to be appreciated that the accompanying drawings are not necessarily to scale since the emphasis is instead placed on illustrating the principles of the invention. The invention will now be described, by way of example, with reference to the accompanying drawings in which:

FIG. 5 diagrammatically shows pivoting movement of the neck, according to the present invention, relative to a remainder of the guitar body in order to achieve lower string action;

FIG. 6 diagrammatically shows pivoting movement of the neck, according to the present invention, relative to a remainder of the guitar body in order to achieve higher string action;

FIG. 7 diagrammatically shows pivoting movement of the neck, about a pivot axis defined by the nut, relative to a remainder of the guitar body, according to the present invention;

DETAILED DESCRIPTION OF THE INVENTION

The present invention will be understood by reference to the following detailed description, which should be read in conjunction with the appended drawings. It is to be appreciated that the following detailed description of various embodiments is by way of example only and is not meant to limit, in any way, the scope of the present invention.

Figure 1:
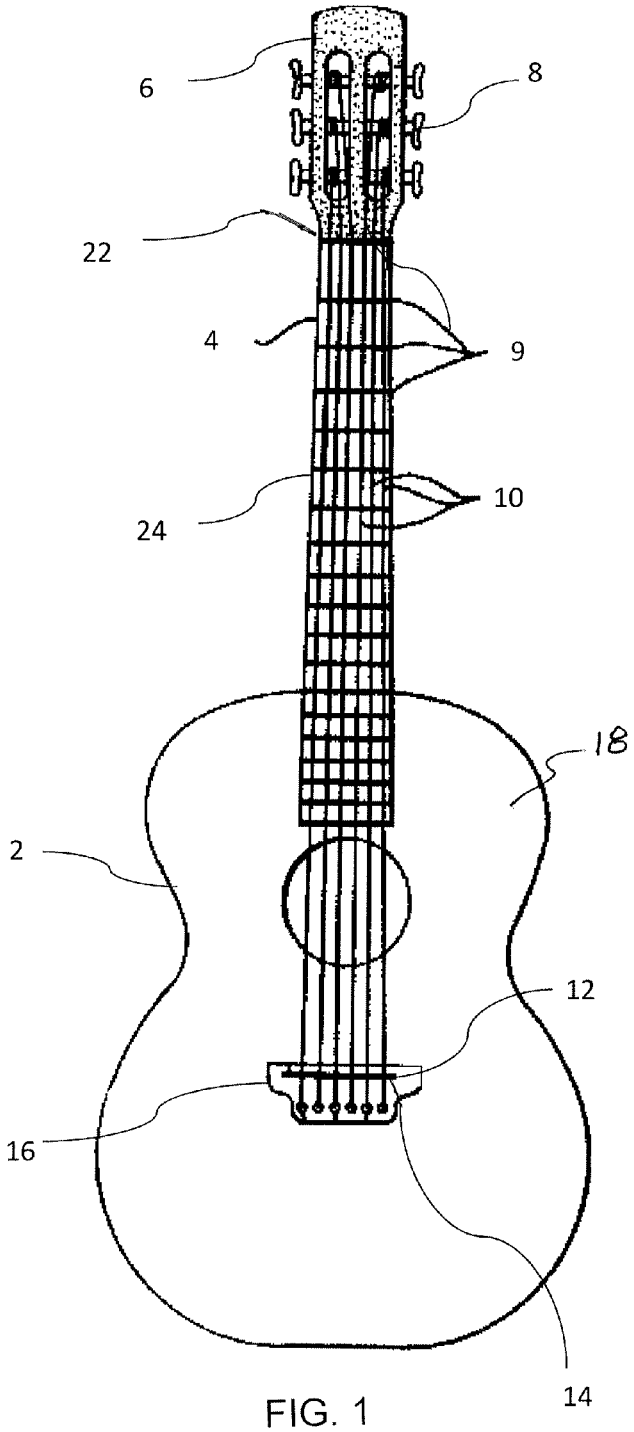
FIG. 1 is a diagrammatic perspective view of a guitar.
Figure 2:
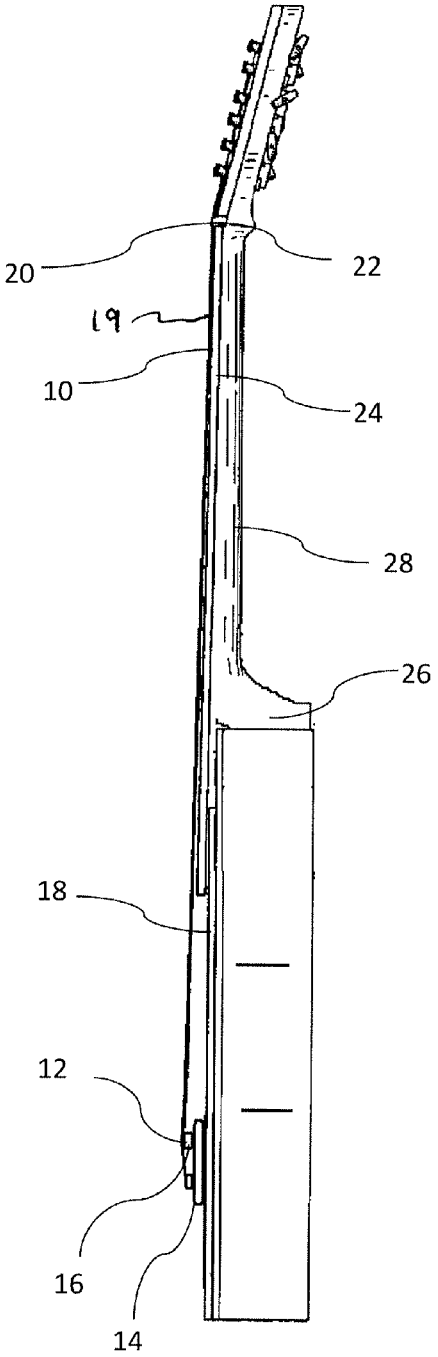
FIG. 2 is a diagrammatic side view of the guitar of FIG. 1.

Turning first to FIGS. 1 and 2, a brief description concerning the various components of the stringed instrument, according to both the prior art and the present invention, will now be briefly discussed. As shown in this Figure, a guitar body 2 is connected to a neck 4 in a conventional manner. The neck 4 typically comprises wood or some other similar or conventional material, which is suitable to withstand continual string pull without warping or twisting. The neck 4 has an integral headstock 6 which holds a number of separate conventional tuning pegs 8 (typically 6 or possibly 12 tuning pegs) which each, in turn, respectively retain a free end of a desired string 10 in a conventional manner. The strings 10 are strung at substantial tension (e.g., about 30 pounds of tension per string) and extend from a first fixed point or axis 12, formed by a saddle 14 support by a bridge 16 which is permanently affixed to a top surface 18 of the guitar body 2, to a second fixed axis 20, formed by the nut 22 which is permanently affixed to a top surface 19 of the neck 4, located adjacent the headstock 6.

A fretboard 24, which is manufactured from a hard substance such as rosewood, ebony, or a re-enforced polymer, mates with a top surface of the neck 4 so as to be located between and space a remainder of the neck 4 from the strings 10. The material from which the fretboard 24 is manufactured should be strong, durable and stable enough to support and retain metal frets 9 and withstand playing wear for many, many years. A heel 26 extends from a bottom surface of the neck 4 and the heel 26 is formed integrally with a remainder of the neck 2.

Figure 3:
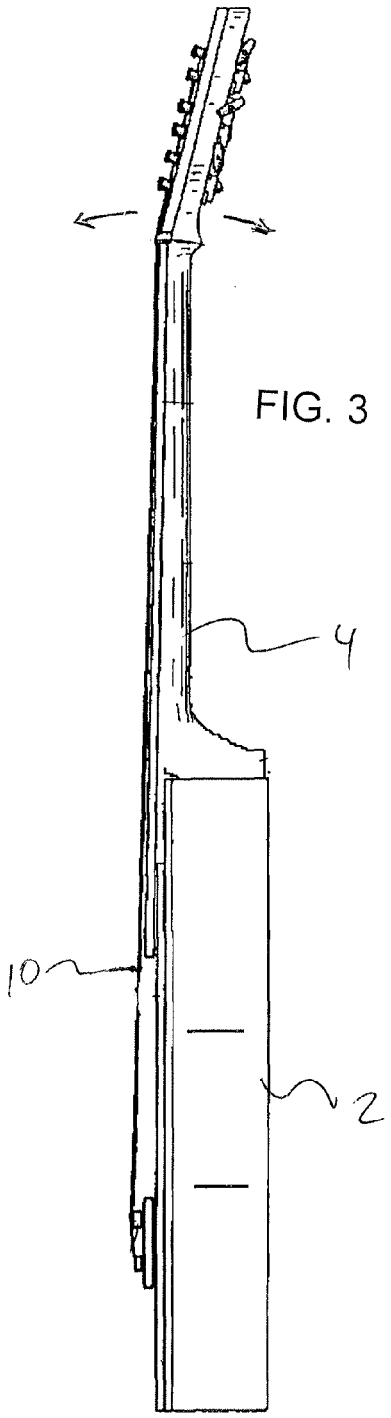
FIG. 3 diagrammatically shows a prior art technique of pivoting of the headstock end of the neck relative to a remainder of the guitar body.
Figure 4:
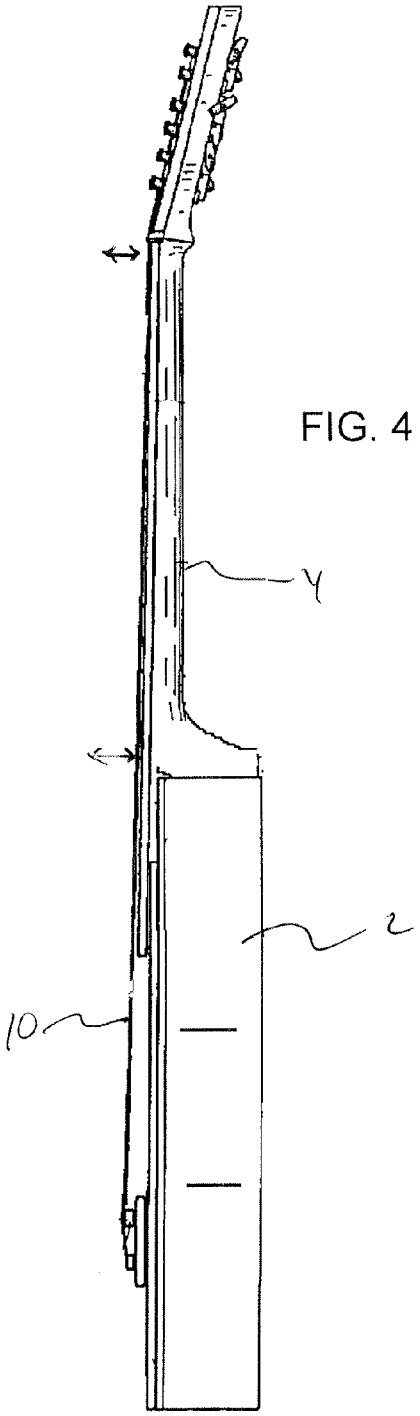
FIG. 4 diagrammatically shows a prior art technique of elevating the entire neck relative to a remainder of the guitar body.

With reference now to FIGS. 3 and 4, a brief description concerning a couple of prior art techniques for changing the playability of the strings are diagrammatically shown. The first technique of pivoting the headstock 6 end of the neck 4 relative to a remainder of the guitar body 2 is diagrammatically shown in FIG. 3 while the second technique of elevating the entire neck 4 relative to a remainder of the guitar body 2 is diagrammatically shown in FIG. 4.

As noted above, one of the drawbacks associated with each one of these prior art adjustment techniques is that any change in the relative position of the neck 4 with respect to the body 2—even only a minute change—has a tendency to alter the intonation, the tonal properties and/or the scale lengths of the guitar strings.

With reference now to FIGS. 5-7, a brief description concerning the general concept of pivoting only the heel 26, or heel end 32, of the neck 4 relative to the guitar body 2 while the position of nut 22 remains substantially unchanged, according to the present invention, will now be described. This description will then be followed by a detailed description concerning a few embodiments incorporating the pivoting aspect according to the present invention.

As noted above, it is important to maintain the precise fixed spacing or distance F between the first fixed axis 12, formed by the saddle 14, and the second fixed axis 20, formed by the nut 22. In particular, it is important to maintain this fixed distance F during any relative adjustment of the neck 4 with respect to the guitar body 2 when adjusting the action of the strings 10. Since fixed distance F remains constant, such adjustment does not vary or effect the pitch or the intonation of the strings, following string action adjustment.

In order to maintain the constant spacing between the first and the second fixed axes 12, 20, i.e., the fixed distance F, during adjustment of the neck 4 relative to the guitar body 2, the inventor discovered that the second fixed axis 20 must be coincident and form the pivot axis P for the neck 4. This arrangement allows the heel end of the neck 4 to pivot a small distance along a curved arcuate path relative to both the strings 10 and the guitar body 2 and thereby alter the action of the strings 10, without altering the pitch and the intonation qualities of the strings 10. That is, as the neck 4 pivots about pivot axis P, which is coincident with second fixed axis 20 defined by the nut 22, the fix distance F of the strings 10 remain unchanged so that at least the pitch and the intonation of the strings 10, following any string action adjustment, also remain unchanged and thereby avoid any necessary re-tuning of the strings 10 by a musician or a technician.

Accordingly, when the neck 4 is pivoted relative to the strings 10 such that the neck 4 either gradually pivots toward or closer to the strings 10, about the pivot axis P, such pivoting movement decreases the spacing or distance between the fretboard 24 and the strings 10, e.g., achieves lower action (see FIG. 5). On the other hand, when the neck 4 is pivoted relative to the strings 10 such that the neck 4 pivots away or further from the strings 10, about the pivot axis P, such pivoting movement increases the spacing or distance between the fretboard 24 and the strings 10, e.g., achieves higher action action (see FIG. 6).

Figure 8:
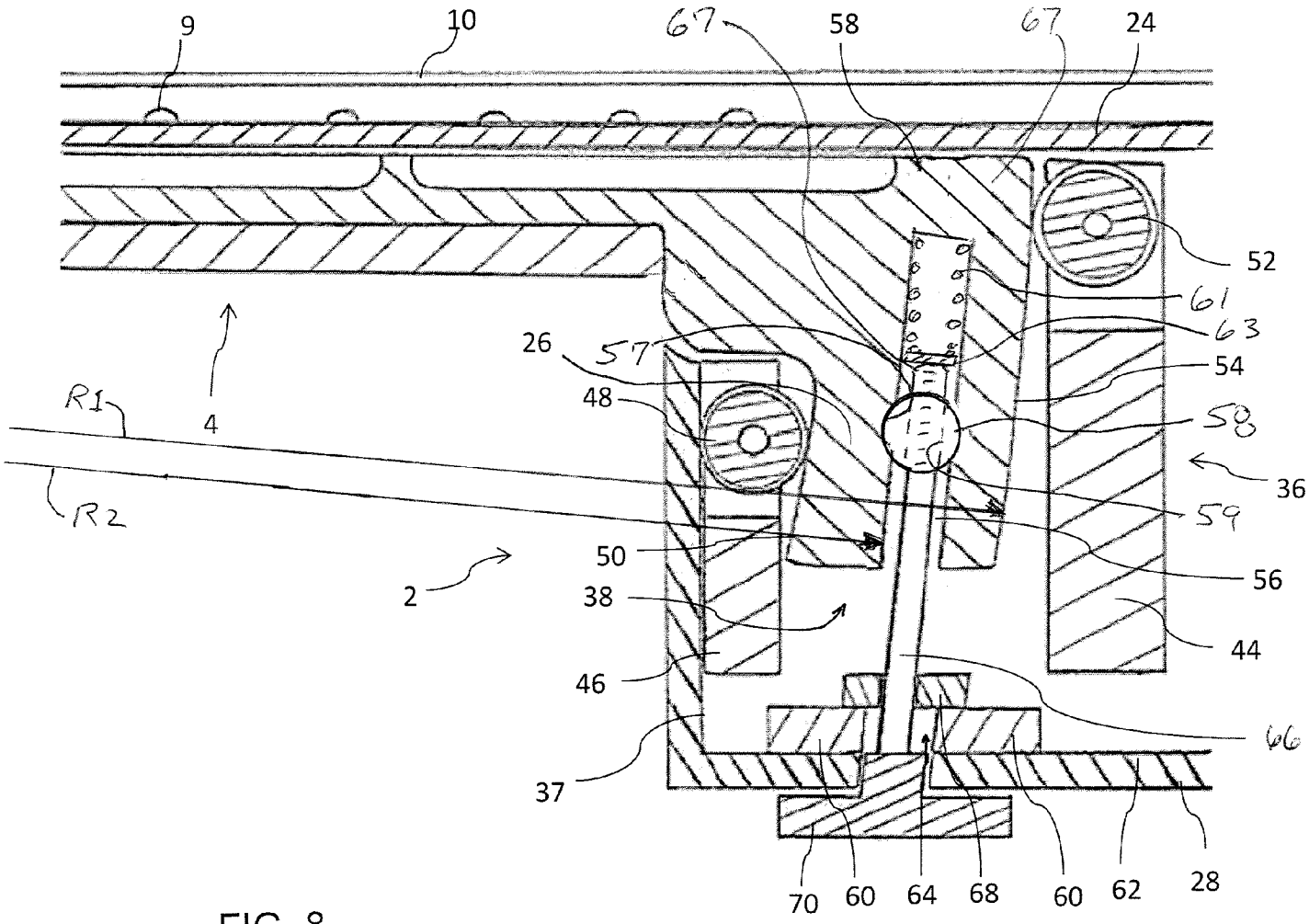
FIG. 8 is a diagrammatic cross-sectional view of the neck and the guitar body interface showing a first embodiment of the present invention.
Figure 9:
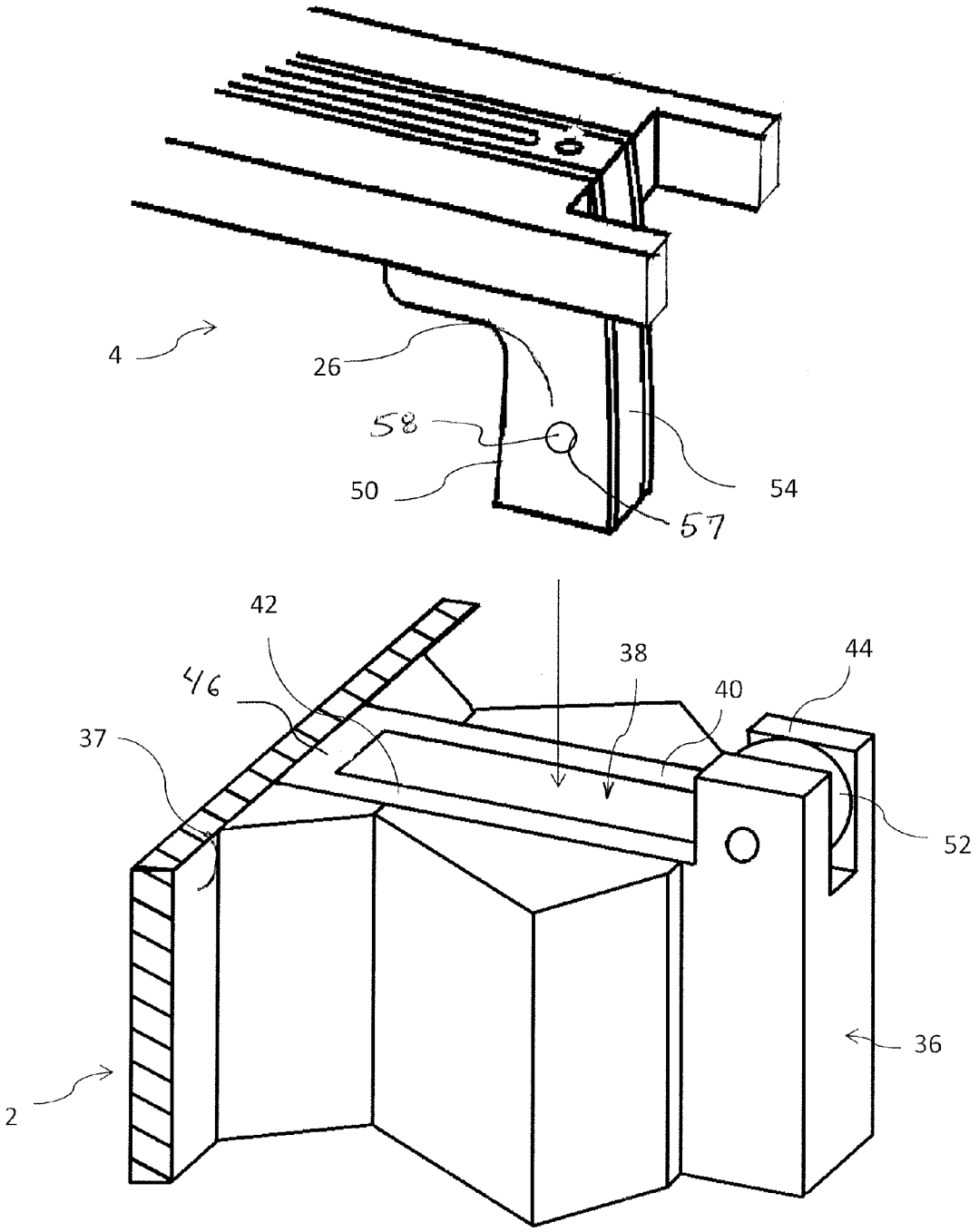
FIG. 9 is a diagrammatic perspective view showing assembly of the neck with the guitar body according to the first embodiment of the present invention.
Figure 10:
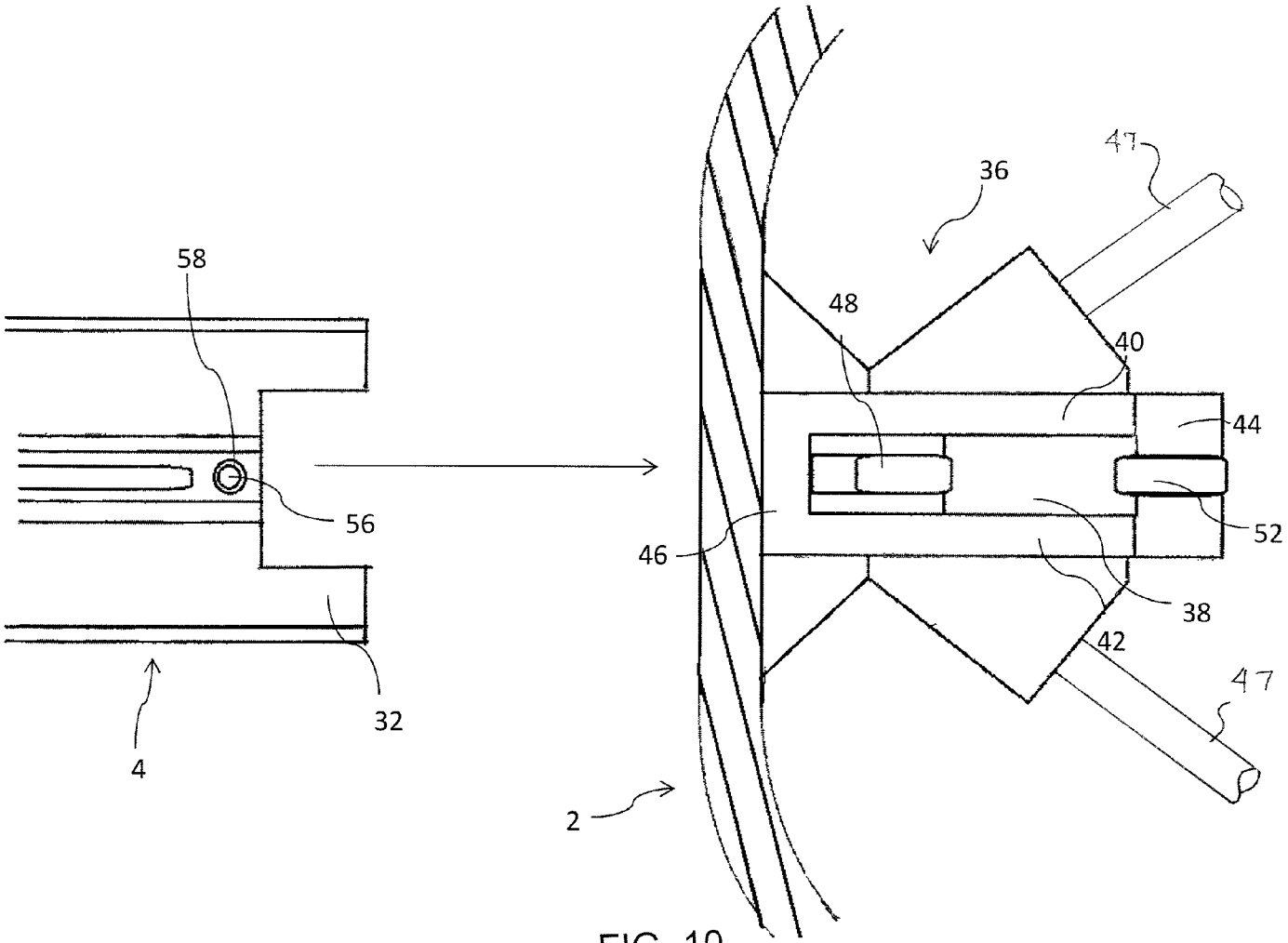
FIG. 10 is a diagrammatic top plan view showing assembly of the neck with the guitar body according to the first embodiment of the present invention.

With reference now to FIGS. 8, 9, and 10, a first embodiment of the present invention will now be discussed in detail. As shown therein, a neck block 36 is secured to an inwardly facing surface 37 of a front wall of the guitar body 2 so as to become an integral part of the guitar body 2. The neck block 36 is typically glued or otherwise fastened to at least the inner surface 37 of the front wall of the guitar body 2 so as to facilitate secure attachment of the neck 4 thereto. The neck block 36 defines a centrally located pocket 38 therein which is sized so as to intimately receive the heel 26 of the neck 4 and facilitates pivoting movement thereof. The pocket 38 extends substantially normal to both the top and bottom surfaces 18, 28 of the guitar body 2 and, as shown in FIGS. 9 and 10, the pocket 38 is defined by a pair of planar opposed sidewalls 40, 42, a body end wall 44, located closest to the bridge 16 of the guitar body 2, and a neck end wall 46 located closest to the inwardly facing surface 37 of the front wall of the guitar body 2. Typically a triangular shaped support block 45 is secured, e.g., glued, to the outer surfaces of each one of the planar opposed sidewalls 40, 42 to provide additional rigidity to the neck block 36. A strut 47 on some other member extends from a planar surface of each one of the triangular shaped support blocks 45 to an inwardly facing side surface of the guitar body 2 to provide further support for the neck block 36 within the guitar body 2.

As shown in FIG. 8, a first roller bearing 48 (e.g., a sealed bearing on an aluminum shaft) is rotatably supported by the neck end wall 46 and arranged to engage with a first arcuate surface 50 formed on the heel 26 of the neck 4 while a second roller bearing 52 (e.g., a sealed bearing on an aluminum shaft) is rotatably supported by an upper portion of the body end wall 44 and arranged to engage with an opposed second arcuate surface 54, also formed on the heel 26 of the neck 4. As shown in this Figure, the first roller bearing 48 is located closer to the bottom surface 28 of the guitar body 2 while the second roller bearing 52 is located closer to the top surface 18 of the guitar body 2. The pocket 38 of the neck block 36 and the heel 26 of the neck 4 are both correspondingly sized to have a relatively close sliding fit with one another so as to permit the neck 4 to slide relative to the neck block 36 and substantially only pivot about pivot axis P while minimize any undesired twisting, turning and/or lateral movement of the neck 4 with respect to the guitar body 2. Preferably either one or both of the inwardly facing side surfaces 40, 42 of the pocket 38 and/or one or both of the outwardly facing surfaces of the heel 26 of the neck 4 support or comprise a low friction surface, e.g., such as G10 phenolic, so as to facilitate the desired relative sliding movement between those components with only minimal friction being encountered during such sliding movement.

A relatively thin planar reinforcing member 60, e.g., a piece of wood, is adhesively secured or otherwise permanently fastened to an inwardly facing surface of the bottom surface 28 of the guitar body 2, adjacent a bottom surface of the heel 26 of the neck 4. The reinforcing member 60 provides addition rigidity to the bottom surface 28 of the guitar body 2. A through hole 64 is drilled and passes through both the bottom surface 28 of the guitar body 2 as well as the reinforcing member 60. This through hole 64 is formed so as to be aligned with an opening 56, e.g., a blind drilled hole, formed in the bottom surface of the heel 26 of the neck 4. An adjustment screw 66 extends completely through the hole 64, formed through both the bottom surface 28 of the guitar body 2 and the reinforcing member 60, and into pocket 38 of the neck block 36. A threaded leading end 67 of the adjustment screw 66 extends into the opening 56 formed in the bottom surface of the heel 26 of the neck 4.

A dowel aperture 57 is drilled into one of the side surfaces of the heel 26 and the dowel aperture 57 is aligned normal and coincident with the opening 56, formed in the bottom surface of the heel 26, so that the dowel aperture 57 intersects with the opening 56. A rotatable dowel nut 58 is accommodated within and captively received by the dowel aperture 57, while the dowel nut 58 is rotatable relative to the dowel aperture 57 to facilitate alignment with the adjustment screw 66. The dowel nut 58 includes an internally threaded bore 59 which extends normal to a longitudinal length of the dowel nut 58 and the threaded bore 59 is located so as to be coincident with the opening 56 and thereby facilitate threaded engagement with the leading end 67 of the adjustment screw 66 when received within the the opening 56.

An anti-backlash spring 61 is normally accommodated within the blind opening 56, e.g., the spring 61 is located between the dowel nut 58 and the closed bottom end (not labeled) of the blind opening 56. A slidable disc 63 typically spaces and separates the dowel nut 58 from the anti-backlash spring 61. During installation, a leading end 67 of the adjustment screw 66 engages and passes through the threaded bore 59 of the dowel nut 58 and eventually abuts against a bottom surface of the slidable disc 63. As the adjustment screw 66 threadedly engages further with the threaded bore of the dowel nut 58, the slidable disc 63 is forced, by a leading end of the adjustment screw 66, against one end of the anti-backlash spring 61 which, in turn, causes compression of the anti-backlash spring 61. Such compression of the anti-backlash spring 61 maintains the threads of the adjustment screw 66 in continuous contact with the threads of the threaded bore 59 of the dowel nut 58 so as to provide an anti-backlash feature, e.g., avoid any lost motion caused by any gap or spacing between the threads of the adjustment screw 66 and the threads of the threaded bore 59.

To further assist with avoiding any lost contact between the threads of the adjustment screw 66 and the mating threads of the threaded bore 59, a M5-8 (Metric screw thread size) can be utilized as the adjustment screw 66 and a 10-32 (American screw thread size) can be utilized as the thread of the threaded bore of the dowel nut 58. These two thread sizes are sufficiently complementary with one another and also further assist with avoiding any lost contact between the threads of the adjustment screw 66 and the mating threads of the threaded bore 59.

A shaft collar 68 is secured to the adjustment screw 66, adjacent the head or knob 70, so that the shaft collar 68 and the head or knob 70 sandwich both the reinforcing member 60 and the bottom surface 28 of the guitar body 2 therebetween. Such sandwiching arrangement of the shaft collar 68 and the head or knob 70 permits rotational movement of the adjustment screw 66, with respect to the bottom surface 28 of the guitar body 2 and the reinforcing member 60, while substantially eliminating any axial movement of the adjustment screw 66 relative to the bottom surface 28 of the guitar body 2 and the reinforcing member 60. That is, the shaft collar 68 and the head or knob 70 facilitate retaining the head or knob 70 in substantially continuous contact with the bottom surface 28 of the guitar body 2, regardless of the rotational direction of the adjustment screw 66. The adjustment screw 66 typically has a length of about 3 inches±1.5 inches and has a relatively fine thread pitch, e.g., about 20 to 32 threads per inch.

When the head or knob 70 of the adjustment screw 66 rotates in a clockwise rotational direction, the leading end 67 of the adjustment screw 66 threadedly engages further with the the threaded bore 59 of the dowel nut 58. Such rotation of the adjustment screw 66 slowly, gradually and incrementally pulls or draws the heel 26 of the neck 4 toward the bottom surface 28 of the guitar body 2, and thereby causes the neck 4 to pivot slowly and gradually about the pivot axis P, which is coincident with the second fixed axis 20 defined by the nut 22. Such pivoting or rotational motion of the neck 4, in turn, increases the spacing or distance between the strings 10 and the fretboard 24, e.g., thereby providing higher string action.

On the other hand, when the head or knob 70 of the adjustment screw 66 rotates in a counter-clockwise rotational direction, the leading end 67 of the adjustment screw 66 is slowly, gradually and incrementally threaded toward less engagement with the threaded bore 59 of the dowel nut 58. The secure engagement between the shaft collar 68 with the adjustment screw 66, on one side, and the head or knob 70, on the opposite side, prevents axial movement of the adjustment screw 66 relative to the bottom surface 28 of the guitar body 2 and the reinforcing member 60. This arrangement ensures that any counter-clockwise rotation of the adjustment screw 66 slowly, gradually and incrementally pushes or forces the heel 26 of the neck 4 away from the bottom surface 28 of the guitar body 2. Accordingly, such counter-clockwise rotation of the adjustment screw 66 enables the neck 4 to pivot gradually about the pivot axis P, which is coincident with the second fixed axis 20 defined by the nut 22. Such pivoting motion of the neck 4, in turn, decreases the spacing or distance between the strings 10 and the fretboard 24, e.g., provides lower string action.

This rotational or pivoting motion is made possible because the roller bearings 48, 52 each respectively engage with and rotate along a respective front or rear surface 50, 54 of the heel 26. According to this embodiment, the first front arcuate surface 50, formed on the heel 26 of the neck 4, comprises an arcuate section which has a radius of curvature R1 (e.g., about 18 inches±6 inches) with its center precisely located coincident with pivot axis P of the neck 4. The second rear arcuate surface 54, also formed on the heel 26 of the neck 4, comprises an arcuate section which has a radius of curvature R2 (e.g., about 17 inches±6 inches) with its center also precisely located coincident with pivot axis P of the neck 4. The radiuses of curvature of the first and the second arcuate surfaces 50, 54 ensure that the rotational motion, between the roller bearings 48, 52 and the arcuate surfaces 50, 54, confines the neck 4 so that the neck solely and gradually pivots about the pivot axis P and thereby adjusts the string action without effecting at least the pitch and the intonation of the attached strings 10.

Figure 8A:
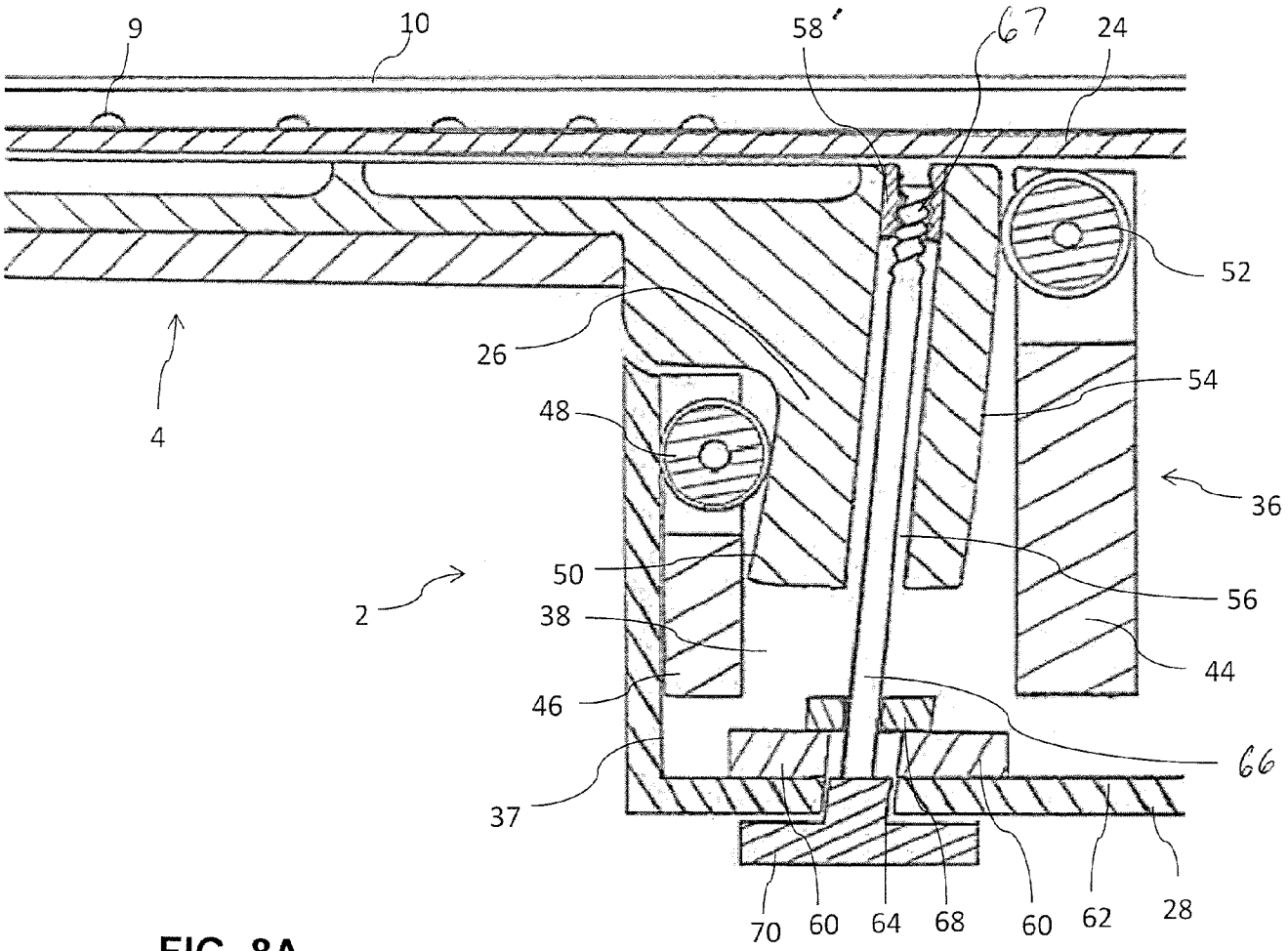
FIG. 8A is a diagrammatic cross-sectional view showing a modification of the first embodiment of the present invention.

Turning now to FIG. 8A, a slight modification of the first embodiment will now be briefly discussed. As with the previous embodiment, the bottom surface of the heel 26 of the neck 4 has an opening 56 formed therein, e.g., a drilled hole. However, instead of a dowel nut 58 being secured therein, a threaded collar 58' is securely received and retained within this opening 56, e.g., by an interference fit, a compression fit and/or gluing, etc., typically closely adjacent the fretboard 24. The adjustment screw 66 extends completely through the hole 64, formed in both the bottom surface 28 of the guitar body 2 and the reinforcing member 60, into the pocket 38 of the neck block 36 and into the opening 56. A leading end 67 of the adjustment screw 66 threadedly engages with an internal thread carried by the threaded collar 58' which is permanently supported within the opening 56 to facilitate adjustment of the string action of the strings 10, as previously discussed.

Figure 10A:
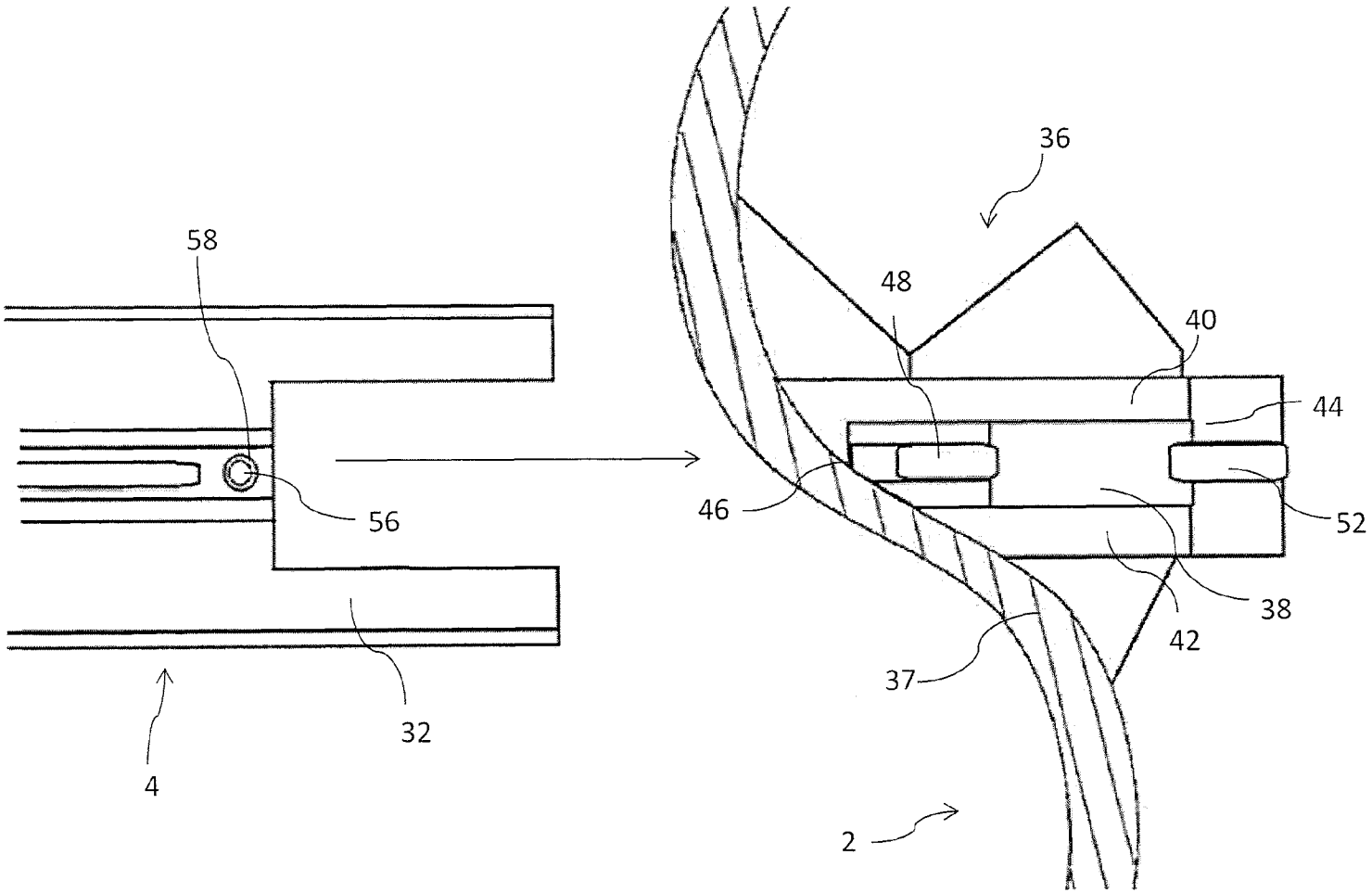
FIG. 10A is a diagrammatic top plan view showing a modification relating to the shape of a front end of the guitar body and a corresponding modification to the front end of the neck block in order to facilitate a musician reaching higher notes along the fretboard.

It is to be appreciated that the shape of the guitar body 2 can be modified, as desired, to improve the playability of the guitar by a musician. In particular, the front surface of the guitar body 2 may be contoured or modified, as shown in FIG. 10A, to include a cut out section. This cut out section facilitates placement of one of the musician's hands lower along the fretboard 24, i.e., closer to the bridge 16 of the guitar 2, so that the higher notes along the fretboard 24 can more easily be reached and played by one or more fingers of the musician. Due to this cut out of the guitar body 2, the neck block 36 is correspondingly modified so as to intimately engage with the front surface 37 of the guitar body 2 and facilitate secure attachment of the neck block 36 thereto.

Figure 11:
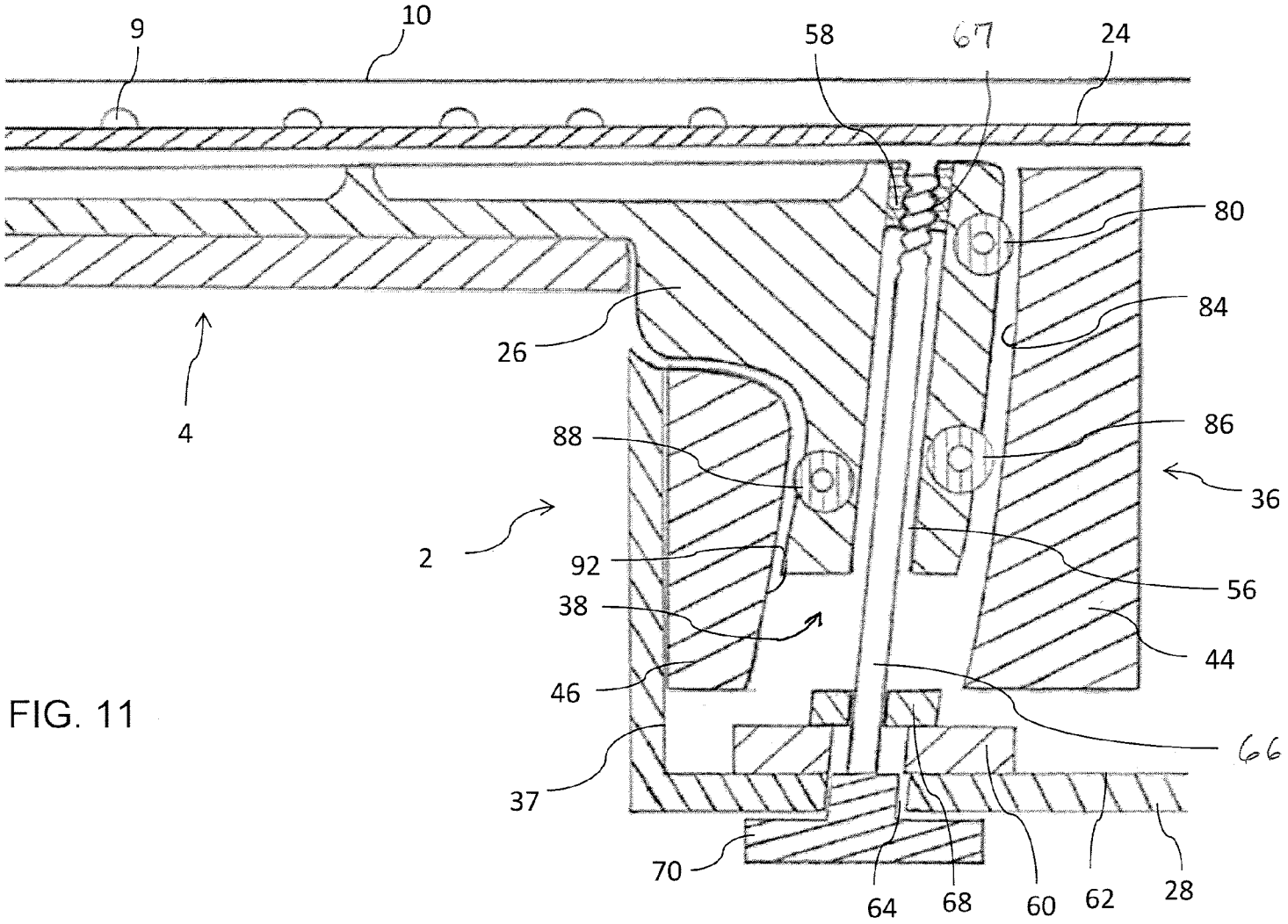
FIG. 11 is a diagrammatic cross-sectional view of the neck and the guitar body interface showing a second embodiment of the present invention.
Figure 12:
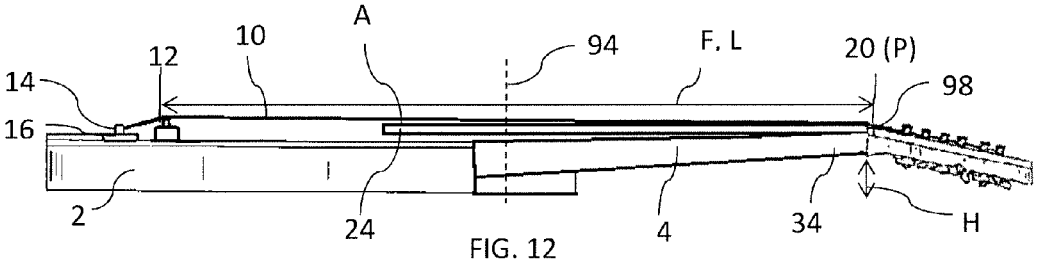
FIG. 12 is a diagrammatic side elevational view showing, according to a third embodiment, adjustment of a guitar toward lower string action.
Figure 13:
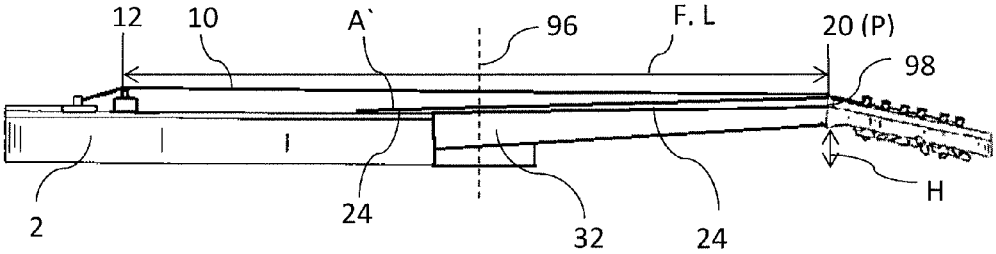
FIG. 13 is a diagrammatic side elevational view showing, according to the third embodiment, adjustment of the guitar toward higher string action.

Turning now to FIG. 11, a second embodiment of the present invention will now be described. As this embodiment is quite similar to the previously discussed embodiment, only the differences between this embodiment and the previous embodiment will be discussed in detail while identical elements will be given identical reference numerals.

As shown in this Figure, the orientation of the rollers and the arcuate surface are generally reversed. That is, the heel 26 of the neck 4 supports the roller bearings 80, 86, 88 while inwardly facing end surfaces of the neck block 36 supports and carry the mating arcuate surfaces 84, 92. According to this embodiment, the first and the second roller bearings 80, 86 (e.g., sealed bearings on aluminum shafts) are rotatably supported by the heel 26 and both arranged to engage with a first arcuate surface 84 formed on the inwardly facing surface of the body end wall 44 of the neck block 36. The third roller bearing 88 (e.g., a sealed bearing on an aluminum shaft) is also rotatably supported by the heel 26 and arranged to engage with an opposed second arcuate surface 92 formed on the inwardly facing surface of the neck end wall 46 of the neck block 36.

As shown in FIG. 11, the first roller bearing 80 is located closer to the top surface 18 of the guitar body 2 while the second and the third roller bearings 86, 88 are located further away from the top surface 18 of the guitar body 2. The heel 26 of the neck 4 and the pocket 38 of the neck block 36 are both sized to have a relatively close sliding fit with one another so as to permit the neck 4 only to pivot with respect to the pivot axis P and thereby minimize any undesired twisting, turning and/or lateral movement of the neck 4 with respect to the guitar body 2. Preferably one or more of the inwardly facing surfaces of the pocket 38 and/or the outwardly facing surfaces of the heel 26 of the neck 4 comprise or are from of a low friction surface, e.g., such as G10 phenolic, so as to facilitate the desired relative sliding movement between those components with only minimal friction being experienced between those components.

The first arcuate surface 84, formed on an inwardly facing surface of the body end wall 44 of the neck block 36, comprises an arcuate section which has a radius of curvature R1 (e.g., generally about 18 inches±6 inches for an average guitar) with its center located at the pivot axis P of the neck 4 (as diagrammatically illustrated in FIG. 7). The second arcuate surface 92, formed on the inwardly facing surfaces of the neck end wall 46 of the neck block 36, also comprises an arcuate section which has a slightly smaller radius of curvature (e.g., generally about 17 inches±6 inches for an average guitar)

with its center also located that the pivot axis P of the neck 4. As this embodiment operates substantially in the same manner as previously discussed embodiment, a further detailed discussion concerning the same is not provided.

Turning now to FIGS. 12-15, a third embodiment of the present invention will now be briefly described. As this embodiment is somewhat similar to the previously discussed embodiments, only the differences between this embodiment and the previous embodiments will be discussed in detail while identical elements will be given identical reference numerals.

According to the first and the second embodiments, the fixed distance F between the saddle 14 and the nut 22 is maintained by pivoting the entire neck 4, including the fretboard 24, relative to the guitar body 2 about the second fixed axis 20 which is coincident with the pivot axis P defined by the nut 22. According to the third embodiment, however, only the fretboard 24 is pivotable secured and rotatable about the second fixed axis 20, via a hinge or a pivot 98, for example, while the neck 4 and the the guitar body 2 remain fixedly attached to one another, in a conventional manner, so as to retain the fixed spacing or distance F, between the saddle 14 and the nut 22. That is, a first end of the fretboard 24 is pivotable attached to the neck 4, preferably either substantially coincident with the nut 22 (e.g., pivotably attached to the neck 4 at the interface between a base of the nut 22 and the neck 4 or pivotally attached closely adjacent to that interface. The opposite second end of the fretboard 24 is pivotable relative to both the heel end of the neck 4 and the strings 10. Due to this arrangement, only the fretboard 24 is adjustable or move toward and/or away from the strings 10 in order to adjust the string action of the strings 10 while a remainder of the neck 4 remains in a substantially fixed position relative to both these strings 10 and the guitar body 2.

The bottom surface of the fretboard 24 has an opening 56' formed therein, e.g., a drilled hole, and a dowel nut 58 or a threaded collar 58' is securely received and retained within this opening 56', e.g., by an interference or a compression fit, gluing, drilling, etc. The adjustment screw 66 is attached to the bottom surface 28 of the guitar body in a similar to that described above. The leading end 67 of the adjustment screw 66 threadingly engages with either the dowel nut 58 or the threaded collar 58' which is retained by the bottom surface of the fretboard 24. Similar to previous embodiments, the secure engagement of the shaft collar 68 with the adjustment screw 66, on one side, and the head or knob 70, on the opposite side, prevents any axial movement of the adjustment screw 66, with respect to the hole 64 or the reinforcing member 60, during either clockwise rotation or counter-clockwise rotation of the adjustment screw 66. As a result of this arrangement, the adjustment screw 66 facilitates adjustment of the spacing S, S' and string action A, A' by rotation of the head or knob 70 in the desired rotational direction.

Accordingly, when the head or knob 70 rotates the adjustment screw 66 in a counter-clockwise rotational direction, the fretboard 24 gradually rotates or pivots, about the pivot axis P, toward the strings 10 and away from the heel end of the neck 4 to thereby decrease the spacing or distance between the fretboard 24 and the strings 10, e.g., achieves lower string action A, but correspondingly increase the spacing or distance S between a bottom surface of the fretboard 24 and a top surface of the neck 4. This is generally diagrammatically shown in FIGS. 12 and 15.

On the other hand, when the head or knob 70 rotates the adjustment screw 66 in a clockwise rotational direction, the fretboard 24 gradually rotates or pivots, about the pivot axis P, away from the strings 10 and toward the heel end of the neck 4 to thereby increase the spacing or distance between the fretboard 24 and the strings 10, e.g., achieves higher string action A', but decrease the spacing S' between the bottom surface of the fretboard 24 and the top surface of the neck 4. This is generally diagrammatically shown in FIGS. 13 and 14.

According to this embodiment, instead of the fretboard 24 being securely attached to the neck 4, as with the previous embodiments, only the pivoted end of the fretboard 24 is securely attached to the neck 4, via the hinge or the pivot 98, while a remainder of the fretboard 24 is thus movable toward and away from the top surface of the neck 4. The heel end of the neck 4 is typically attached or otherwise secured to the body 2 in a conventional manner.

Figure 14:
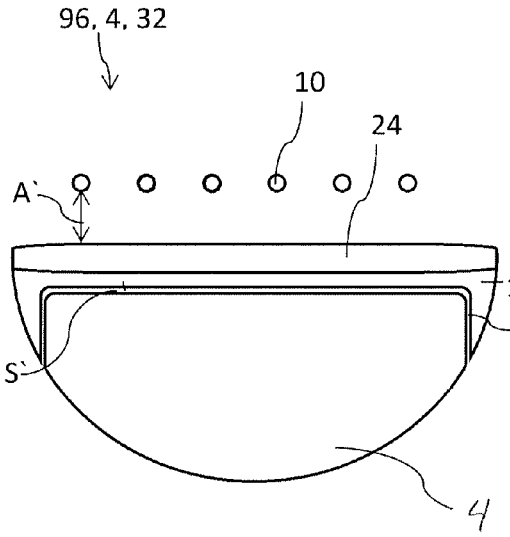
FIG. 14 is a diagrammatic cross-sectional view showing, according to the third embodiment, adjustment of the guitar toward higher string action.
Figure 15:
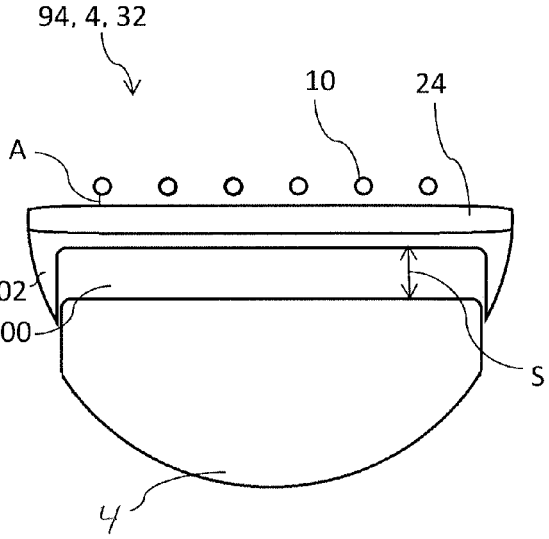
FIG. 15 is a diagrammatic cross-sectional view showing, according to the third embodiment, adjustment of the guitar toward lower string action.

As diagrammatically shown in FIGS. 14 and 15, the fretboard 24 has a pair of opposed lateral side walls which at least partially wrap around and overlap the opposed lateral side surfaces of the neck 4. Due to this arrangement, the pair of opposed lateral side walls of the fretboard 24 and the lateral side surfaces of the neck 4 together form a pair of opposed, substantially continuous lateral side surfaces which facilitates sliding of a musician's hand therealong, while playing the guitar, and still permit the free end of the fretboard 24 to rotate or pivot with respect to the neck 4. The pair of opposed lateral side walls of the fretboard 24 define an elongate pocket 100 therebetween, for receiving a top portion of the neck 4, and the elongate pocket 100 which generally extend the entire length of the fretboard 24. The height of the elongate pocket 100 is greatest adjacent the heel 26 while the height of the elongate pocket 100 gradually decreases toward the nut 22.

Figure 16:
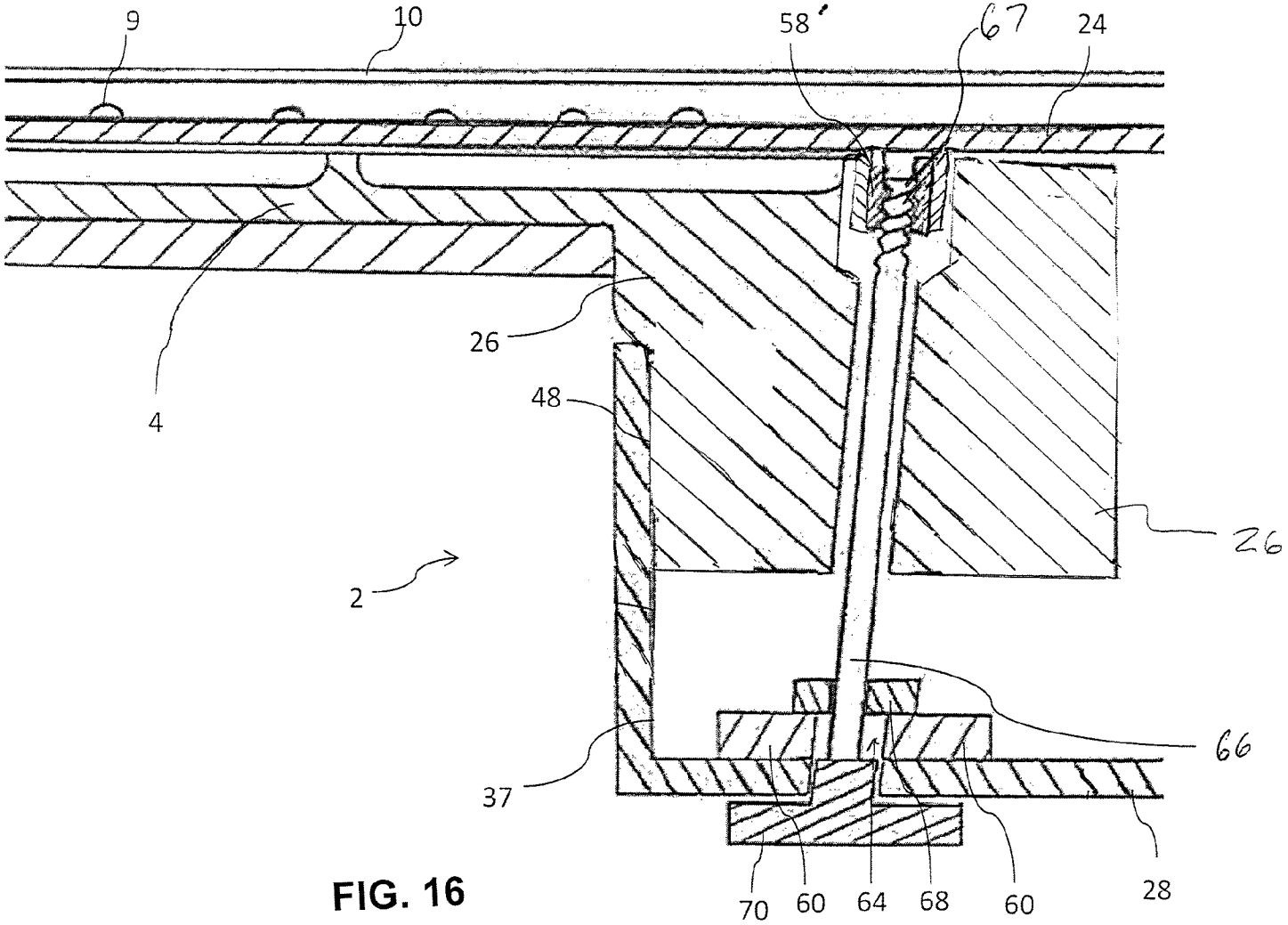
FIG. 16 is a diagrammatic cross-sectional view of adjustment mechanism for the fretboard according to third embodiment of the present invention.

The adjustment mechanism, for this embodiment, is diagrammatically shown in FIG. 16. As shown, a bottom surface of the fretboard heel has an opening 56 formed therein, e.g., a drilled hole and a threaded collar 58' is securely received and retained within this opening 56, e.g., by an interference fit, a compression fit and/or gluing, etc., typically closely adjacent the fretboard 24. An adjustment screw 66 extends completely through the hole 64, formed in both the bottom surface 28 of the guitar body 2 and the reinforcing member 60, and into the opening 56. A leading end 67 of the adjustment screw 66 threadedly engages with an internal thread carried by the threaded collar 58', which is permanently supported within the opening 56, to facilitate adjustment of the string action of the strings 10, as previously discussed.

Figure 17:
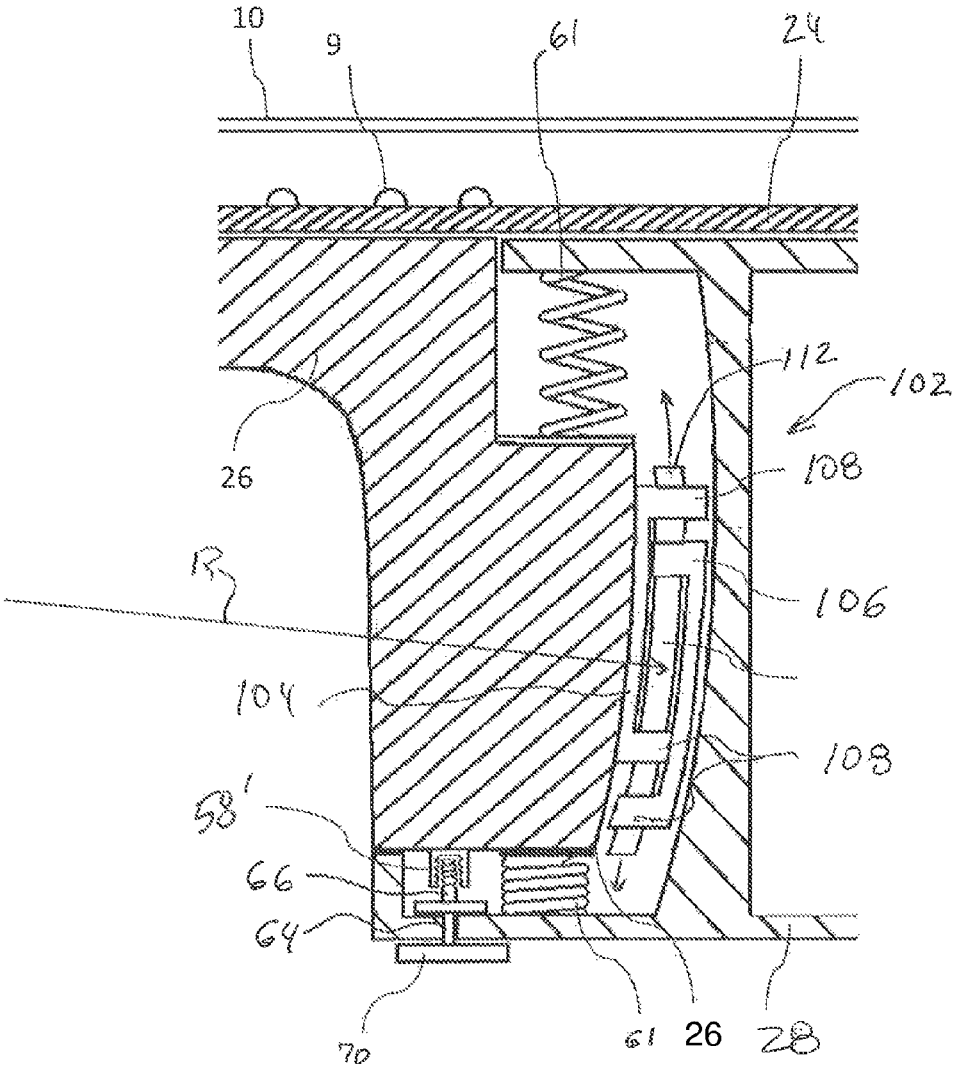
FIG. 17 is a diagrammatic cross-sectional view of the neck and the guitar body interface showing a fourth embodiment of the present invention.
Figure 18:
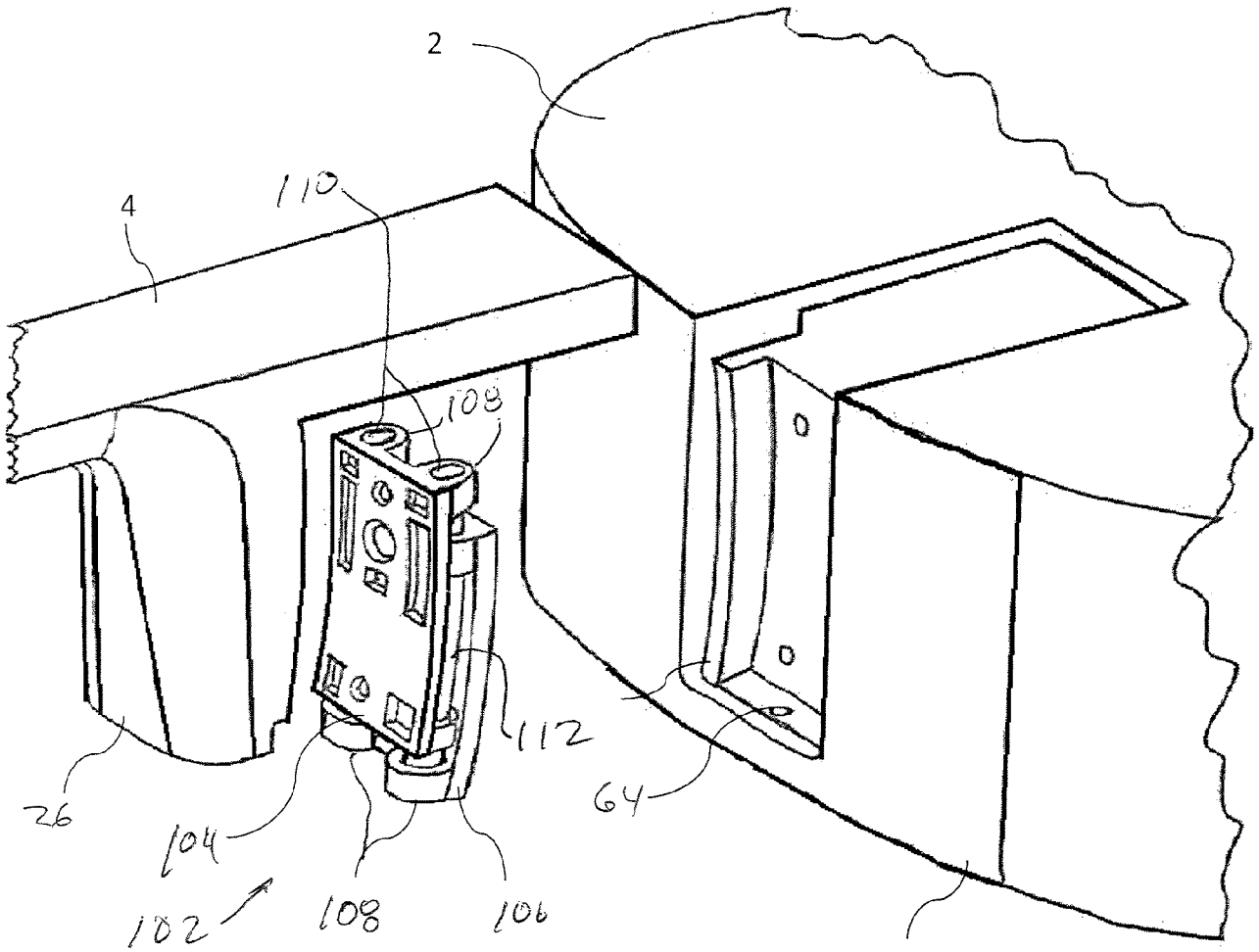
FIG. 18 is an exploded, diagrammatic perspective view of the fourth embodiment of the present invention.

With reference now to FIGS. 17 and 18, a fourth embodiment of the present invention will now be discussed. As this embodiment is somewhat similar to the previously discussed embodiments, only the differences between this embodiment and the previous embodiments will be discussed in detail while identical elements will be given identical reference numerals.

According to this embodiment, an arcuate bracket assembly 102 is utilized for coupling or interconnecting the neck 4 to the guitar body 2. The arcuate bracket assembly 102 generally comprises a neck bracket 104, which is permanently attached to the keel 26 of the neck 4 by one or more conventional fasteners, such as bolts, screws, etc. (not shown), while a body bracket 106 is permanently attached to the guitar body 2 of the neck 4 by one or more conventional fasteners, such as bolts, screws, etc. (not shown).

As shown in these Figures, each one of the neck and the body brackets 104, 106 supports first and second sets of spaced apart pairs of rod supports 108 (see FIG. 18). Each one of the rod supports 108 has a through bore 110 extending therethrough which is sized to receive and intimately engage with a corresponding end of either a first or a second arcuate shape rod 112. That is, a first pair of the spaced apart rod supports 108 of the neck bracket 104 receives and accommodates respective ends of the first arcuate shape rod 112 while a second pair of the spaced apart rod supports 108 of the neck bracket 104 receives and accommodates respective ends of the second arcuate shape rod 112. Each one of the arcuate shaped rods 112 is permanently attached to at least one of the spaced apart pairs of rod supports 108 of the neck bracket 104 to facilitate permanent retention of the first and the second arcuate shaped rods 112 to the neck bracket 104 and prevent rotation of the arcuate shaped rods 112 relative to the rod supports 108.

Each one of the arcuate shape rods 112 typically has a radius of curvature R of between 17.5 inches±12 inches so that the center of the radius of curvature of each one of the arcuate shaped rods 112 is coincident with the pivot axis P defined by the nut 22.

The body bracket 106 also has first and second sets of pairs of the spaced apart rod supports 108. The first pair of the spaced apart rod supports 108 of the body bracket 106 also receives and accommodates respective ends of the first arcuate shape rod 112 while the second pair of the spaced apart rod supports 108 of the body bracket 106 also receives and accommodates respective ends of the second arcuate shape rod 112. However, neither one of the first or the second arcuate shaped rods 112 is fixedly attached to any of the spaced apart pairs of rod supports 112 of the body bracket 108. As a result of this arrangement, the neck bracket 104 and the body bracket 106 are able to slide, relative to one another, along an arcuate shaped path defined by the first and second arcuate shaped rods 112. It is to be appreciated that the arrangement of the first and second sets of pairs of the spaced apart rod supports 108, supported by the neck bracket 104 and the body bracket 106, can be reversed without departing form the spirit and scope of the present invention. As a result of such arrangement, any sliding motion of the rod supports 108, along the arcuate shaped rods 112, correspondingly induces the neck 4 to pivot in along an arcuate path without substantially changing at least the pitch and the intonation of the attached strings 10.

As with the previous embodiments, a hole 64 is drilled through the bottom surface 28 of the guitar body 2 and possibly a reinforcing member (not specifically shown in this Figure). An adjustment screw 66 extends through the hole 64 and a leading end of the adjustment screw 66 threadedly engages with a threaded collar 58' which is permanently supported either by the bottom surface of the heel 26 of the neck 4 or within an opening (not shown) formed therein.

A shaft collar 68 is secured to the adjustment screw 66, closely adjacent the head or knob 70, so that the shaft collar 68 and the head or knob 70 sandwich the rear surface 28 of the guitar body 2 (and the reinforcing member if present) therebetween so as to substantially eliminate any axial movement of the adjustment screw 66 relative to at least the rear surface 28 of the guitar body 2.

As with the previous embodiments, when the head or knob 70 of the adjustment screw 66 is rotated in a clockwise rotational direction, the leading end of the adjustment screw 66 further threadedly engages with the threaded collar 58' to slowly, gradually and incrementally pull or draw the heel 26 of the neck 4 toward the rear surface 28 of the guitar body 2. Such pivoting or rotational motion of the neck 4, in turn, gradually increases the distance or the spacing between the strings 10 and the fretboard 24, e.g., thereby providing higher string action.

On the other hand, when the head or knob 70 of the adjustment screw 66 is rotated in a counter-clockwise rotational direction, the leading end of the adjustment screw 66 is slowly, gradually and incrementally threaded out of engagement with the threaded collar 58'. The secure engagement of the shaft collar 68 with the adjustment screw 66, on one side, and the head or knob 70, on the opposite side, prevents any axial movement of the adjustment screw 66 relative to at least the bottom surface 28 of the guitar body 2. This arrangement ensures that the counter-clockwise rotation of the adjustment screw 66 slowly, gradually and incrementally pushes or forces the heel 26 of the neck 4 away from the rear surface of the guitar body 2. Such pivoting motion of the neck 4, in turn, decreases the distance or the spacing between the strings 10 and the fretboard 24, e.g., provides lower string action. One or more springs 61, e.g., compression springs, engages with the heel 26 of the neck 4 to provide an anti-backlash feature, e.g., avoid any lost motion caused by any gap or spacing between components such as between the threads of the adjustment screw 66 and the threads of the threaded collar 58' or possibly a dowel nut.

It is to be appreciated that the head may be partially or completely recessed within the bottom surface of the guitar body, if desired for aesthetic reasons or the like, and such modification may require, depend upon the amount of recessing of the head, a tool of some sort to facilitate access and actuation of the adjustment mechanism for pivoting the heel end of the neck, relative to the pivot axis defined by the nut, along the curved arcuate path. In such instance, the head may possibly have a male hex shape and the tool would have mating female hex shape, or vise versa.

While various embodiments of the present invention have been described in detail, it is apparent that various modifications and alterations of those embodiments will occur to and be readily apparent those skilled in the art. However, it is to be expressly understood that such modifications and alterations are within the scope and spirit of the present invention, as set forth in the appended claims. Further, the invention(s) described herein is capable of other embodiments and of being practiced or of being carried out in various other related ways. In addition, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items while only the terms "consisting of" and "consisting only of" are to be construed in the limitative sense.

Furthermore, the use of certain terminology herein is for the purpose of reference only, and are not intended to be limiting. Terms such as "upper", "lower", "above", "below", "rightward", "leftward", "clock wise", and "counterclockwise" refer to directions in the drawings to which reference is made. Terms such as "inward" and "outward" refer to directions toward and away from, respectively, the geometric center of the component described. Terms such as "front", "rear", "side", "left side", "rightside", "top", "bottom", "horizontal", and "vertical" describe the orientation of portions of the component within a consistent but arbitrary frame of reference which is made clear by reference to the text and the associated drawings describing the component under discussion. Such terminology will include the words specifically mentioned above, derivatives thereof, and words of similar import.

Wherefore, I claim:

1. A stringed instrument with an adjustment mechanism for adjusting an action of a plurality of strings of the stringed instrument, and the stringed instrument comprising:

a body;

a bridge supported by the body;

a saddle affixed to the bridge;

a neck pivotably coupled to the body by a heel remote from a headstock;

a fretboard supported by the neck;

a nut affixed to the neck adjacent the headstock;

the plurality of strings extending between the nut and the saddle; and the adjustment mechanism for facilitating adjustment of the action of the plurality of strings;

wherein the neck is coupled to the body via at least one arcuate surface which has a radius, and the radius of the at least one arcuate surface has a center which is coincident with the nut which defines a pivot axis for the neck such that when the adjustment mechanism is actuated, at least a heel end of the fretboard is pivoted about the pivot axis, defined by the nut, to adjust the string action of the plurality of strings while maintaining the constant spacing between the nut and the saddle.

2. The stringed instrument with the adjustment mechanism according to claim 1, wherein the fretboard is fixedly attached to the neck so that the neck pivots along with the fretboard; and the adjustment mechanism facilitates pivoting of the heel end of the neck along a curved arcuate path, relative to both the plurality of strings and the body, so as to alter the action of the plurality of strings without altering a pitch of the plurality of strings.

3. The stringed instrument with the adjustment mechanism according to claim 2, wherein a neck block is secured to the body; and the neck block defines a centrally located pocket which is sized to receive the heel of the neck and facilitate pivoting movement of the heel end of the neck, relative to the pivot axis defined by the nut, along the curved arcuate path.

4. The stringed instrument with the adjustment mechanism to claim 3, wherein the at least one arcuate surface is formed on the heel of the neck, and at least one roller bearing is rotatably supported by the neck block; and the at least one roller bearing engages with the at least one arcuate surface so as to facilitate pivoting movement of the heel end of the neck, relative to the pivot axis defined by the nut, along the curved arcuate path.

5. The stringed instrument with the adjustment mechanism according to claim 3, wherein the at least one arcuate surface is formed on the neck block; and at least a first roller bearing is rotatably supported by the heel of the neck so as to facilitate pivoting movement of the heel end of the neck, relative to the pivot axis defined by the nut, along the curved arcuate path.

6. The stringed instrument with the adjustment mechanism according to claim 1, wherein the saddle defines a first fixed axis for the plurality of strings;

the pivot axis of the nut defines a second fixed axis; and the adjustment mechanism, when adjusting the heel end of the neck relative to the plurality of strings, for adjusting an action of the plurality of strings, maintains a constant distance between the first and the second fixed axes so as to avoid effecting at least the pitch of the plurality of strings, following any string action adjustment.

7. The stringed instrument with the adjustment mechanism according to claim 1, wherein a neck block is secured to the body and defines a pocket which is sized to receive the heel of the neck and facilitate pivoting movement thereof; and the pocket is defined by a pair of opposed sidewalls, a body end wall and a neck end wall.

8. The stringed instrument with the adjustment mechanism according to claim 1, wherein the at least one arcuate surface comprises both first and second arcuate surfaces respectively formed on front and rear surfaces of the heel of the neck;

a first roller bearing, rotatably supported by the neck block, engages with the first arcuate surface; and a second roller bearing, rotatably supported by the neck block, engages with the second arcuate surface, so as to facilitate pivoting movement of the heel of the neck, relative to the pivot axis defined by the nut, along the curved arcuate path.

9. The stringed instrument with the adjustment mechanism to claim 1, wherein the at least one arcuate surface is formed on one of the heel of the neck and a neck block of the stringed instrument;

at least a first roller bearing is rotatably supported by the other of the neck block and the heel of the neck;

the first roller bearing engages with the at least one arcuate surface so as to facilitate pivoting movement of the heel end of the neck, relative to the pivot axis defined by the nut, along the curved arcuate path; and the at least one arcuate surface has a radius of curvature about 17.5 inches±12 and the center is coincident with the nut.

10. The stringed instrument with the adjustment mechanism to claim 1, wherein a reinforcing member is secured to an inwardly facing bottom surface of the body, adjacent the heel of the neck;

a through hole extends through both the bottom surface and the reinforcing member and is aligned with an opening formed in a bottom surface of the heel of the neck;

an adjustment screw extends through the hole and into the opening formed in the bottom surface of the heel of the neck; and the heel of the neck matingly engages with a leading end of the adjustment screw to facilitate adjustment of a position of the heel of the neck, relative to the bottom surface of the body, during actuation of the adjustment mechanism.

11. The stringed instrument with the adjustment mechanism according to claim 10, wherein a reinforcing member is secured to an inwardly facing bottom surface of the body, adjacent the heel of the neck;

a through hole extends through both the bottom surface and the reinforcing member and is aligned with an opening formed in a bottom surface of the heel of the neck;

an adjustment screw extends through the hole and into the opening formed in the bottom surface of the heel of the neck; and a dowel nut is accommodated by the heel of the neck and matingly engages with a leading end of the adjustment screw to facilitate adjustment of a position of the heel of the neck, relative to the bottom surface of the body, during actuation of the adjustment mechanism;

a dowel aperture is drilled into the heel of the neck and the dowel aperture extends normal and coincident with the the opening formed in the bottom surface of the heel of the neck, so that the dowel aperture intersects with the opening formed in the bottom surface of the heel of the neck;

the dowel nut is accommodated within and captively received by the dowel aperture;

the dowel nut is rotatable relative to the dowel aperture to facilitate alignment with the adjustment screw; and the dowel nut includes an internally threaded through bore which facilitates threaded engagement with the leading end of the adjustment screw when received within the the opening formed in the bottom surface of the heel of the neck.

12. The stringed instrument with the adjustment mechanism according to claim 10, wherein the adjustment mechanism has an anti-backlash spring.

13. The stringed instrument with the adjustment mechanism according to claim 10, wherein a shaft collar is secured to the adjustment screw, closely adjacent a head of the adjustment screw, so that the shaft collar and the head sandwich at least the rear surface of the body therebetween and substantially eliminate axial movement of the adjustment screw, relative to at least the rear surface of the guitar body, during actuation of the adjustment mechanism.

14. The stringed instrument with the adjustment mechanism according to claim 1, wherein a reinforcing member is secured to an inwardly facing bottom surface of the body, adjacent the heel of the neck;

a through hole extends through both the bottom surface and the reinforcing member;

the through is aligned with an opening formed in the bottom surface of the heel of the neck;

an adjustment screw extends through the through hole and into the opening formed in the bottom surface of the heel of the neck;

a threaded collar is secured within the opening; and a leading end of an adjustment screw threadedly engages with the threaded collar to facilitate pivoting movement of the heel of the neck, relative to the pivot axis defined by the nut, along a curved arcuate path.

15. The stringed instrument with the adjustment mechanism according to claim 1, wherein the adjustment mechanism comprises an arcuate bracket assembly which has a neck bracket, permanently attached to the heel of the neck, and a body bracket permanently attached to the body of the neck;

each one of the neck and the body brackets supports first and second sets of spaced apart pairs of rod supports; and each one of first set of the rod supports engage with a first arcuate shape rod and each one of second set of the rod supports engage with a second arcuate shape rod to facilitate pivoting movement of the heel end of the neck, relative to the pivot axis defined by the nut, along a curved arcuate path.

16. The stringed instrument with the adjustment mechanism according to claim 15, wherein a through hole extends through a bottom surface of the body;

a bottom surface of the neck supports a threaded collar; and an adjustment screw extends through the through hole and threadedly engages with the threaded collar, which is secured to the neck, to facilitate pivoting movement of the heel end of the neck, relative to the pivot axis defined by the nut, along a curved arcuate path.

17. The stringed instrument with the adjustment mechanism according to claim 1, wherein the fretboard is pivotally attached to the neck so that the fretboard is pivotable relative to the neck, the adjustment mechanism facilitates pivoting of the heel end of the fretboard along a curved arcuate path, relative to the neck and the plurality of strings, so as to alter the action of the plurality of strings without altering a pitch of the plurality of strings, and the fretboard has a pair of opposed lateral side walls which at least partially wrap around and overlap the opposed lateral side surfaces of the neck.

18. The stringed instrument with the adjustment mechanism according to claim 17, wherein a through hole extends through a bottom surface of the body;

a bottom surface of the fretboard supports a threaded collar; and an adjustment screw extends through the through hole and threadedly engages with the threaded collar, which is secured to the fretboard, to facilitate pivoting movement of the fretboard, relative to the pivot axis defined by the nut, along a curved arcuate path.

19. A guitar with an adjustment mechanism for adjusting an action of a plurality of strings of the guitar, and the guitar comprising:

a guitar body;

a bridge supported by the guitar body;

a saddle affixed to the bridge;

a neck pivotably coupled to the guitar body by a heel;

a fretboard supported by the neck;

a nut affixed to the neck adjacent a headstock;

a neck block being secured to the guitar body, and the neck block having a pocket sized to receive the heel of the neck; and the plurality of strings extending between the nut and the saddle;

wherein the adjustment mechanism facilitating adjustment of the action of the plurality of strings while maintaining a constant spacing between the nut and the saddle;

the nut substantially forms a fixed pivot axis for both the fretboard and the neck;

both a heel end of the fretboard and the heel of the neck are pivotable about the fixed pivot axis, via the adjustment mechanism, for adjusting the action of the plurality of strings, and the adjustment mechanism comprises an arcuate surface which ha a radius with a center which is coincident with the nut so as to facilitate pivoting the heel end of the neck, relative to the pivot axis defined by the nut, along a curved arcuate path to adjust the action of the plurality of strings while maintaining the constant spacing between the nut and the saddle.

20. A method of adjusting string action of a guitar before, after, or during playing, in which the guitar comprises a guitar body, a bridge supported by the guitar body, a saddle affixed to the bridge, a neck pivotably coupled to the guitar body, a fretboard supported by the neck, a nut affixed to the neck adjacent a headstock, a plurality of strings extending between the nut and the saddle, and an adjustment screw of an adjustment mechanism extending through a bottom surface of the guitar body; and the method comprising:

pivotably supporting the at least the fretboard with respect to the guitar body, so that the nut substantially forms a fixed pivot axis for at least the fretboard;

coupling at least the fretboard to the adjustment screw of the adjustment mechanism for pivoting at least the fretboard; and adjusting the string action of the guitar by rotating the adjustment screw of the adjustment mechanism to alter spacing of a heel end of at least the fretboard relative to the bottom surface of the guitar body and pivot at least a heel end of at least the fretboard about the fixed pivot axis, which is coincident with the nut, and alter the string action while still maintaining a constant spacing between the nut and the saddle.

* * * * *